US008111856B2

(12) United States Patent
Shimura et al.

(10) Patent No.: US 8,111,856 B2
(45) Date of Patent: Feb. 7, 2012

(54) VARIABLE DIRECTIONAL MICROPHONE UNIT AND VARIABLE DIRECTIONAL MICROPHONE

(75) Inventors: Haruhito Shimura, Machida (JP); Hiroshi Akino, Machida (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 285 days.

(21) Appl. No.: 12/581,630

(22) Filed: Oct. 19, 2009

(65) Prior Publication Data

US 2010/0098282 A1 Apr. 22, 2010

(30) Foreign Application Priority Data

Oct. 21, 2008 (JP) ..... 2008-271185

(51) Int. Cl.
*H04R 9/08* (2006.01)
*H04R 25/00* (2006.01)

(52) U.S. Cl. ..... 381/356; 381/174

(58) Field of Classification Search ..... 381/174, 381/190, 191, 355, 356, 357, 358, 369
See application file for complete search history.

(56) References Cited

U.S. PATENT DOCUMENTS 6,985,597 B2 * 1/2006 Akino ..... 381/174
7,260,230 B2 * 8/2007 Feng ..... 381/174

FOREIGN PATENT DOCUMENTS

JP 7-143595 A 6/1995
JP 2008-067286 A 3/2008

* cited by examiner

*Primary Examiner* — Brian Ensey
(74) *Attorney, Agent, or Firm* — Sughrue Mion, PLLC

(57) ABSTRACT

A variable directional microphone unit includes two capacitor elements. Each of the two capacitor elements has: a back plate formed on one side of an insulating plate to be insulated from a back plate of the other capacitor element; and a vibrating plate disposed to face the back plate with a certain amount of space therebetween, in which a polarization voltage is applied between each of the back plates and the vibrating plates so that an electroacoustically transduced signal is obtainable from each of the back plates. The variable directional microphone unit is characterized in that the two vibrating plates of the two capacitor elements are acoustically connected in series as a plurality of holes are formed on both of the back plates.

7 Claims, 12 Drawing Sheets

VARIABLE DIRECTIONAL MICROPHONE UNIT AND VARIABLE DIRECTIONAL MICROPHONE

BACKGROUND OF THE INVENTION

1. Field of the Invention

The present invention relates to a variable directional microphone unit in which a physical structure thereof and a structure of a circuit for electrical switching used therewith can be made simple, and to a variable directional microphone.

2. Description of the Related Art

As a microphone with variable directionality, a microphone is known that has a microphone unit composed of two capacitor microphone units connected back-to-back (see, for example, Japanese Patent Application Laid-open No. H7-143595 and No. 2008-67286). Both microphone units have cardioid characteristic. The variable directionality is achieved through adjusting their outputs or, as described in Japanese Patent Application Laid-open No. H7-143595, through adjusting polarization voltages applied to each element.

An example of a conventional variable directional microphone unit similar to those of Japanese Patent Application Laid-open No. H7-143595 and No. 2008-67286 is shown in FIG. 11. In FIGS. 11 to 14, a variable directional capacitor microphone unit is composed of two individually formed capacitor microphone units 21 and 41 connected back-to-back. A diaphragm-like vibrating plate 22 has its outer peripheral portion fixed to one side of a vibrating plate holding ring 23 to compose a vibrating plate assembly therewith. The vibrating plate holding ring 23 is made of a conductive material and an electrode plate 24 having a plurality of acoustic terminal holes 241 is disposed thereon. An electrode 25 electrically conducted to the vibrating plate 22 is fixed to the electrode plate 24. The vibrating plate 22 integrally held by the vibrating plate holding ring 23 is placed on a disk-shaped fixed electrode 26 with a ring-shaped spacer 27 made of an extremely thin insulating material in between. Thus, the vibrating plate 22 faces an upper surface of the fixed electrode 26 with a slight gap with a size corresponding to a thickness of the spacer 27 in between. The spacer 27 is sandwiched by the vibrating plate 22 and the fixed electrode 26 at the position near their outer peripheries.

The fixed electrode 26 is placed on an insulative base 30 with a receiving ring 28 in between. The base 30 has circular flanges 31 and 32 formed along peripheries of an upper and a lower surface thereof, respectively. The receiving ring 28 and the fixed electrode 26 are dropped into a space surrounded by the flange 31. Both upper and lower surfaces of the base 30 gradually inclined towards the center and a vertically through hole is formed at the center. An acoustic resisting member 34 is fit into the hole. A upper surface of the fixed electrode 26 protrudes above that of the flange 31. The spacer 27, the vibrating plate assembly formed of the vibrating plate holding ring 23 and the vibrating plate 22, and the electrode plate 24 are stacked on the fixed electrode 26 in this order. A holding ring 29 is fit around the outer peripheries of the electrode plate 24 and the vibrating plate assembly. The holding ring 29 is also fit around an outer periphery of the flange 31 of the base 30 to be fixed thereto with any appropriate fixing methods. An upper edge of the holding ring 29 is formed to be an inner extending edge 291. As the inner extending edge 291 pushes down the electrode plate 24, the units described above are secured to the base 30 by being urged thereto. The microphone unit 21 is thus formed.

The acoustic terminal holes 241 of the electrode plate 24 serve as a front acoustic terminal of the microphone unit 21. The fixed electrode 26 has a plurality of holes as well. Through the acoustic terminal holes 241 of the electrode plate 24 and the holes formed on the fixed electrode 26, a space behind the vibrating plate 22 is communicated with: a space formed by the upper surface of the base 30 being gradually inclined towards the center; and, via the acoustic resisting member 34, a space formed by the lower surface of the base 30 being gradually inclined towards the center.

The other microphone unit 41 has a similar structure as the above described microphone unit 21 connected back-to-back therewith. The microphone unit 41 includes: a vibrating plate 42; a vibrating plate holding ring 43; an electrode plate 44; an electrode 45; a fixed electrode 46; a spacer 47; a receiving ring 48; a holding ring 49; a front acoustic terminal 441 formed of a plurality of holes; and an inner extending edge 491 of the holding ring 49. Above elements have similar structures as that of the corresponding elements of the microphone unit 21. At the lower surface side of the base 30, the microphone unit 41 is formed as the counterpart of the microphone unit 21. Polarization voltages are individually applied to the vibrating plates 22 and 42 of the microphone units 21 and 41.

FIG. 15 depicts an equivalent circuit of the above described microphone unit. In the figure, the two microphone units are connected to each other via acoustic resistance r1 of the acoustic resisting member 34. The microphone unit 21 is at the left of the acoustic resistance r1 while the microphone unit 41 is at the right thereof. In the figure, the microphone unit 21 includes: sound pressure $P_1$; mass $m_{OA}$, stiffness $s_{OA}$, and acoustic resistance $r_{OA}$ of a front air chamber; and stiffness $S_{1A}$ of the hole formed in the fixed electrode and a rear air chamber in communication therewith. Similarly, the microphone unit 41 includes: sound pressure $P_2$; mass $m_{OB}$, stiffness $s_{OB}$, and acoustic resistance $r_{OB}$ of a front air chamber; and stiffness $S_{1B}$ of the hole formed in the fixed electrode and a rear air chamber in communication therewith.

FIG. 16 depicts an example of a directionality switching circuit that can be applied to the conventional variable directional microphone unit. Constant polarization voltage is applied to the vibrating plate of one of the microphone units 21 and 41 and a level of polarization voltage applied to the vibrating plate of the other microphone unit is switched. Thus, the directionality of the microphone unit can be switched. The exemplary circuit shown in FIG. 16 has DC power sources of +60V and −60V, and +60V is constantly applied to the vibrating plate of one of the microphone units. Voltages of both power sources of +60V and −60V are divided into two levels (for example, into +60V and +30V, and −60V and −30V). Thus, five levels (including 0V) of voltages are generated. The voltage to be applied to the vibrating plate of the other microphone unit is selected from the five levels by means of a switch. 0V (no voltage) is applied to the fixed electrode (also referred to as "a back plate") included in both microphone units.

FIG. 17 depicts examples of directionalities of the microphone unit obtained through switching between the polarization voltages of different levels by means of the switch. Under a condition in which a contact 1 is selected with a switch shown in FIG. 16, the polarization voltage of +60V is applied to one of the microphone unit whereas the polarization voltage of −60V is applied to the other microphone unit. Here, the microphone unit has bidirectional characteristic as shown in "1" of FIG. 17 in which an output from the front microphone unit is subtracted by an output from the rear microphone unit. Under a condition in which a contact 2 is selected with the switch, the polarization voltage applied to the other microphone unit becomes higher than −60V and lower than 0V (for example −30V). Here, the microphone unit has hypercardioid characteristic as shown in "2" of FIG. 17. Under a condition in which a contact 3 is selected with the switch, polarization voltage of 0V (no polarization voltage) is applied to the other microphone unit. Here, the microphone unit has cardioid characteristic as shown in "3" of FIG. 17 in which only the front microphone unit performs the output. Under a condition in which a contact 4 is selected with the switch, the polarization voltage applied to the other microphone unit becomes higher than 0V and lower than 60V (for example 30V). Here, the microphone unit has wide cardioid characteristic as shown in "4" of FIG. 17. Under a condition in which a contact 5 is selected with the switch, the polarization voltage applied to the other microphone unit is +60V. Here, the microphone unit has omnidirectional characteristic as shown in "5" of FIG. 17 in which the output of the rear microphone unit is added to the output of the front microphone unit.

The directionality of the above described conventional variable directional microphone is variable by connecting two microphone units back-to-back and by making the polarization voltage applied to one of the microphone units variable or, as described above, by making the output level of each of the microphone units variable. However, this method of achieving variable directionality requires a complex circuit structure.

The directionalities the above described variable directional microphone can generally have are cardioid, bidirectional, and omnidirectional. An intermediate of the directionalities can be obtained through further providing alternatives for the mixing ratio of the outputs from the pair of microphone units or the level of the applied polarization voltages. However, this requires even more complex circuit structure.

With the exemplary circuit of FIG. 16, the directionality can be switched between several different levels. Here, the circuit requires the power supplies capable of generating voltages at different levels and the voltage must be selectable. Thus, the circuit structure is complex.

Directionality of handheld microphones widely used on stages and the like is cardioid or hypercardioid. A microphone having which directionality is to be used is chosen according to the sound the user prefers, in terms of preventing acoustic feedback, or the like. The variable directional microphone unit described above may be used but incorporating the switching circuit having such a complex structure as described above in a handheld microphone is difficult.

Therefore, a microphone is called for that has a simple circuit structure and enables the user to arbitrarily select the directionality from cardioid, hypercardioid, and supercardioid.

SUMMARY OF THE INVENTION

The present invention is made to solve the above problems in related art. Thus, the object of the present invention is to provide a variable directional microphone unit and a variable directional microphone having a circuit structure for switching directionality simple enough to be incorporated in a microphone.

In the present invention, a variable directional microphone unit includes two capacitor units. Each of the two capacitor elements has: a back plate formed on one side of an insulating plate to be insulated from a back plate of the other capacitor element; and a vibrating plate disposed to face the back plate with a certain amount of space therebetween, in which a polarization voltage is applied between each of the back plates and the vibrating plates so that an electroacoustically transduced signal is obtainable from each of the back plates. The variable directional microphone unit is characterized in that the two vibrating plates of the two capacitor elements are acoustically connected in series as a plurality of holes are formed on both of the back plates.

EFFECT OF THE INVENTION

A gap composed of a plurality of holes of the vibrating plate and the back plate of one of the capacitor elements serves as an acoustic resistance for the other capacitor element. Thus, directionality of the other capacitor element becomes closer to bidirectional, e.g., becomes hypercardioid. The directionality is variable through selecting or mixing outputs from the capacitor elements. Thus, the structure of the circuit and the physical structure of the microphone unit can be simplified.

DETAILED DESCRIPTION OF THE PREFERRED EMBODIMENTS

Figure 1:
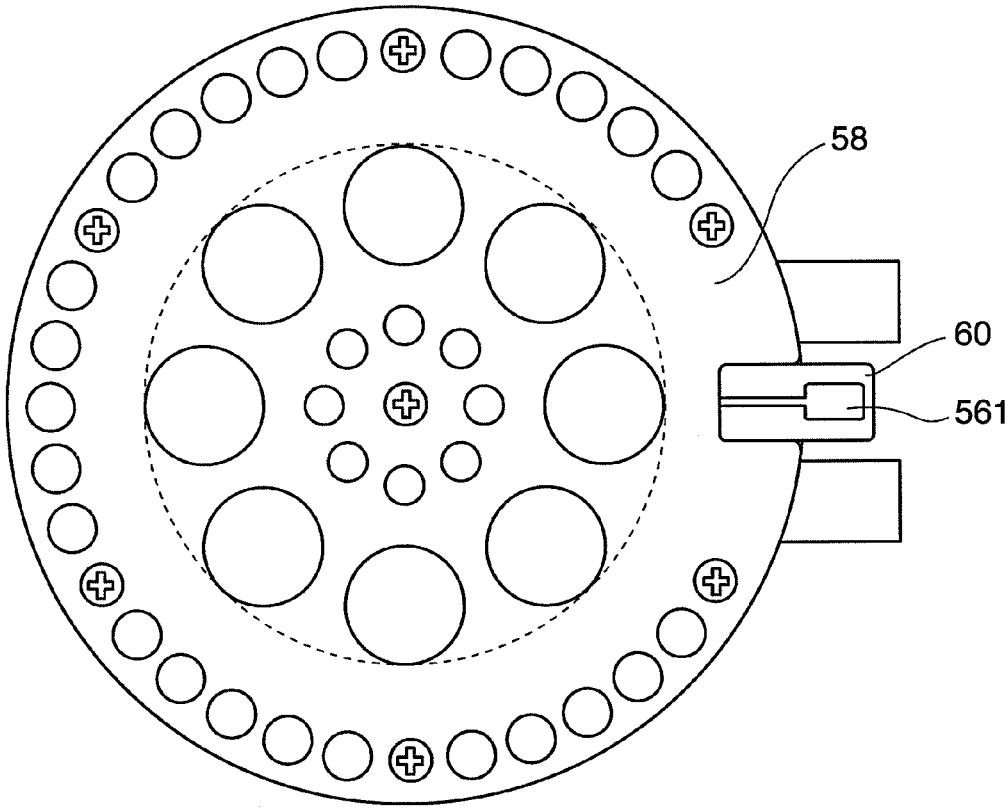
FIG. 1 is a rear view of a variable directional microphone unit of an embodiment according to the present invention.

An embodiment of a variable directional microphone unit and a variable directional microphone according to the present invention is described below with reference to the accompanying drawings.

In FIGS. 1 to 4, an insulating plate 60 has back plates 56 and 76 insulated from each other on the upper surface and the lower surface thereof, respectively. Vibrating plates 52 and 72 are respectively disposed on the back plates 56 and 76 with certain amount of spaces therebetween. Thus, two electrically independent capacitor elements 51 and 71 are formed on the upper and the lower surfaces of the insulating plate 60, respectively. The insulating plate 60 and the back plates 56 and 76 can be fabricated with, for example, a method similar to that for fabricating a printed circuit board. Specifically, the back plates 56 and 76 are conductive circuit patterns formed on both sides of the substrate made of an insulating material. The vibrating plates 52 and 72 are diaphragm-like members made of thin resin films. The vibrating plates 52 and 72 are fixed to one side of vibrating plate holding ring 53 and one side of vibrating plate holding ring 73, respectively to form vibrating plate assemblies.

Instead of being formed on both sides of a single insulating plate 60, each of the two back plates 56 and 76 may be formed on one of the surfaces of two different insulating plates in contact with each other at sides not having the back plates.

The vibrating plate assemblies have the vibrating plates 52 and 72 respectively disposed at sides closer to back plates 56 and 76, respectively. The ring-shaped spacers 57 and 77 are disposed in between the vibrating plate 52 and the back plate 56, and in between the vibrating plate 72 and the back plate 76. With the spacers 57 and 77, slight gaps having sizes corresponding to the thickness of the spacers 57 and 77 are respectively formed between: the vibrating plate 52 and the back plate 56; and the vibrating plate 72 and the back plate 76. The capacitor elements 51 and 71 electrically independent from each other are thus respectively formed with: the vibrating plate 52 and the back plate 56; and the vibrating plate 72 and the back plate 76. Electroacoustically transduced signals can be obtained from the back plates 56 and 76 by applying polarization voltages between: the vibrating plate 52 and the back plate 56; and the vibrating plate 72 and the back plate 76.

Figure 2:
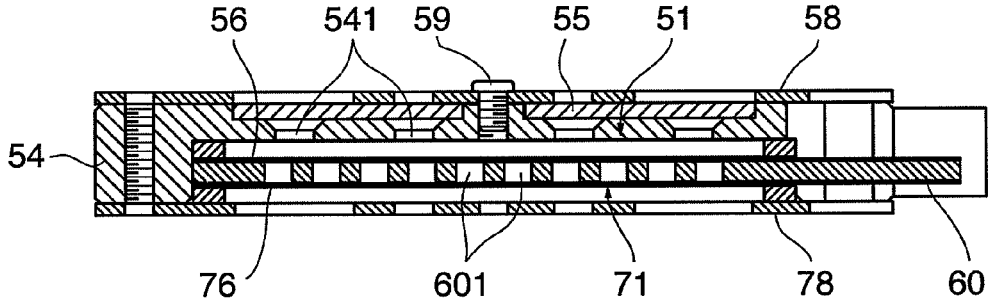
FIG. 2 is a vertical cross sectional view of the variable directional microphone unit.
Figure 3:
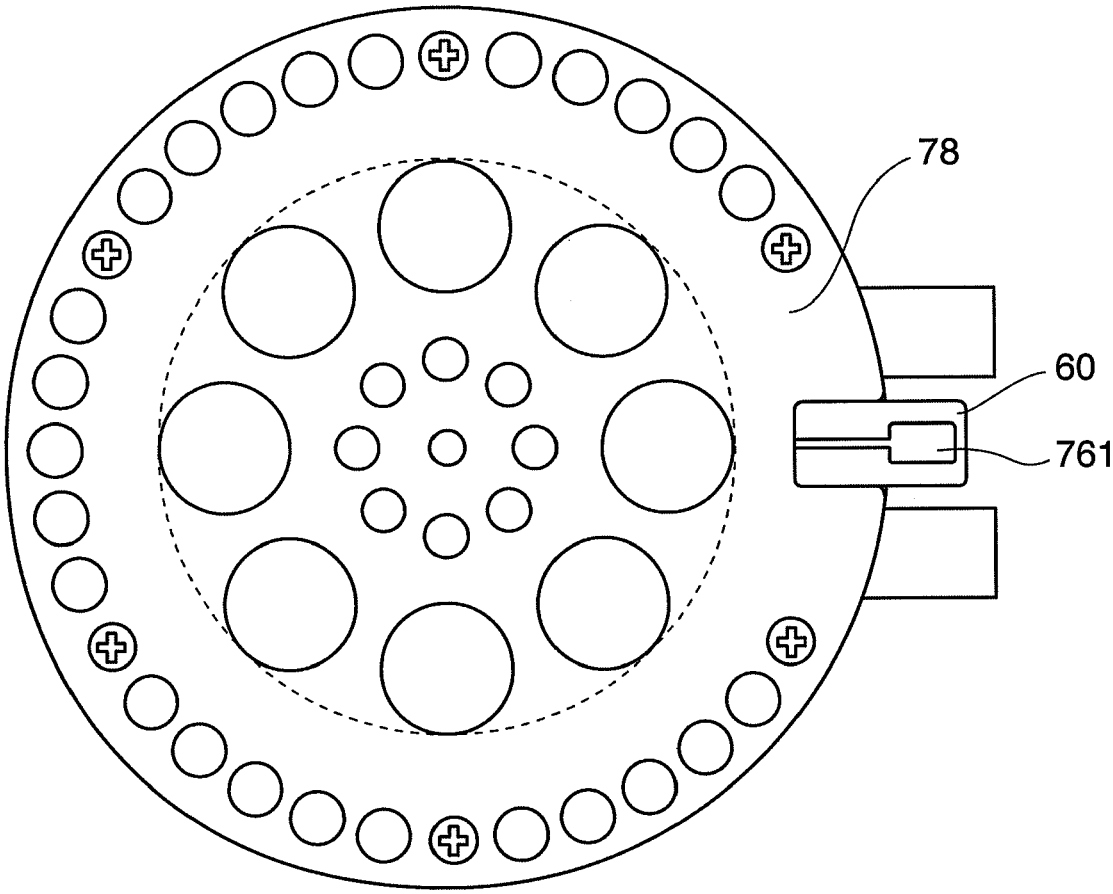
FIG. 3 is a front view of the variable directional microphone unit.
Figure 4:
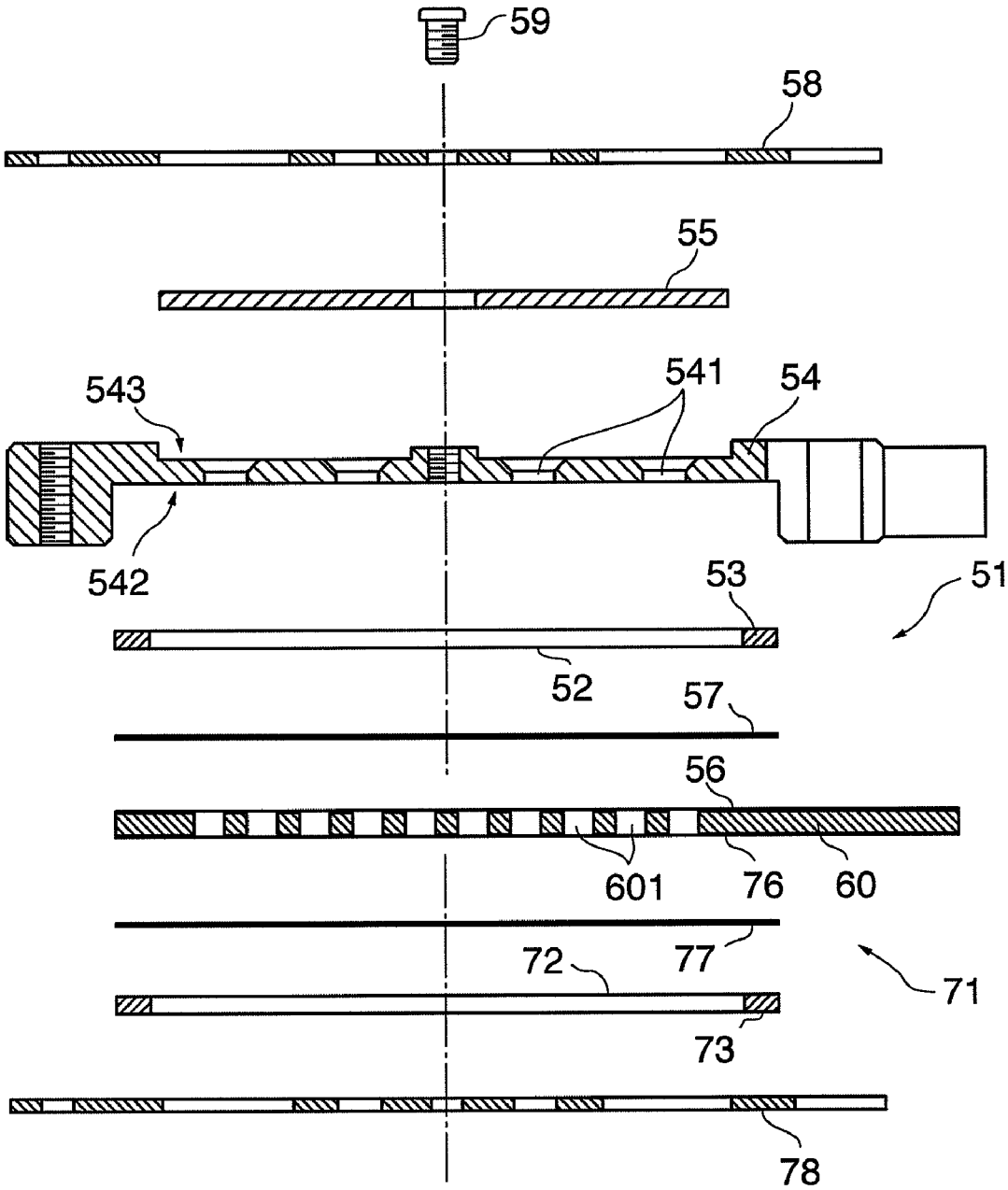
FIG. 4 is an exploded vertical cross sectional view of the variable directional microphone unit.

The insulating plate 60 has a plurality of through holes 601 penetrating in the thickness direction thereof (vertically as viewed in FIGS. 2 and 4). Though it may not be clearly shown in the figures, the back plates 56 and 76 also have a plurality of holes each having the size and the disposed position corresponding to the holes 601. Thus, the two vibrating plates 52 and 72 are acoustically connected in series through the holes formed on the back plates 56 and 76 and the holes 601 formed on the insulating plate 60.

The capacitor elements 51 and 71 are fit in a circular recess 542 formed on one side (a lower side as viewed in FIGS. 2 and 4) of a base 54. More specifically, the vibrating plate assembly formed of the vibrating plate 52 and the vibrating plate holding ring 53, the spacer 57, the insulating plate 60 having the back plates 56 and 76, the spacer 77, and the vibrating plate assembly formed of the vibrating plate 72 and the vibrating plate holding ring 73 are fit in the recess 542 of the base 54 in this order. A holding plate 78 is disposed over the elements and one end face (at the lower side as viewed in FIGS. 2 and 4) of the base 54. As the holding plate 78 is screwed to the base 54 at a plurality of appropriate positions at the peripheral portion thereof, the elements are secured to the base 54 as being urged thereto. The holding plate 78 has a plurality of holes into which sound waves are guided. A part of the insulating plate 60 extends outward in a radial direction. Terminal patterns 561 and 761 are respectively formed on an upper and a lower surfaces of the extended portion to electrically connect the back plates 56 and 76 with outside. A part of the circular flange surrounding the recess 542 of the base 54 is cut out and the extending portion of the insulating plate 60 extends outward therefrom.

The base 54 has a plurality of through holes 541 penetrating in the thickness direction thereof that serves as acoustic terminals disposed in front of the vibrating plate 52 of the capacitor element 51. At the surface of the base 54 at which the recess 542 is not formed, a shallow recess 543 is formed into which a plate shaped acoustic resisting member 55 that covers the holes 541 is fit. The acoustic resisting member 55 and a holding plate 58 are fixed to the base 54 as: the holding plate 58 is disposed to cover the upper surface as viewed in FIGS. 2 and 4 of the acoustic resisting member 55 and the base 54; the holding plate 58 is screwed to the base 54 at a plurality of appropriate position at the periphery thereof; and the center of the holding plate 58 is screwed to the base 54 with a screw 59. The holding plate 58 has a plurality of holes into which sound waves are guided.

As described above, the acoustic resisting member 55 is disposed behind the vibrating plate 52 of the capacitor element 51. Here, the side at which the acoustic resisting member 55 is disposed, i.e., the upper side as viewed in FIGS. 2 and 4, is the rear side that is at an angle of 180° with respect to the direction to which the sound enters, whereas the side at which the acoustic resisting member 55 is not disposed is the front side that is at an angle of 0° with respect to the direction into which the sound enters. With the configuration of the present embodiment, the directionality of the capacitor element 51 at the rear side is closer to bidirectional compared with that of the capacitor element 71 at the front side. This is because the acoustic resisting member 55 is disposed in front of the rear capacitor element 71 but not in front of the front capacitor element 51. The front capacitor element 71 has no acoustic resisting member 55 at the front side thereof and has, at the rear side thereof: acoustic resistance $r_{OB}$ of the space between the vibrating plate 52 of the rear capacitor element 51, and the back plate 56 and the insulating plate 60; and acoustic resistance $r_1$ of the acoustic resisting member 55. Meanwhile, the rear capacitor element 51 has: at the front side thereof, acoustic resistance $r_{OA}$ ($=r_{OB}$) of the space between the vibrating plate 72 of the front capacitor element 71, and the back plate 76 and the insulating plate 60; and at the rear side thereof, the acoustic resistance $r_1$ of the acoustic resisting member 55. Thus, the acoustic resistance ratio between the front side and the rear side differs between the front capacitor element 71 and the rear capacitor element 51. The rear capacitor element 51 has an airspace (a thin airspace between the vibrating plate 72 of the front capacitor element 71 and the back plate 76) at the front as viewed thereform. The airspace serves as front acoustic resistance making the directionality of the rear capacitor element 51 closer to bidirectional compared with that of the front capacitor element 71.

Thus, upon adjusting the acoustic resistance of the acoustic resisting member 55 so that the directionality of the output from front capacitor element 71 becomes cardioid, the directionality of output from the rear capacitor element 51 becomes hypercadioid. This is because the gap formed between the vibrating plate 72 of the front capacitor element 71, and the back plate 76 and the insulating plate 60 serves as the front acoustic member for the rear capacitor element 51 to make the directionality thereof closer to bidirectional.

In the embodiment shown with the figures, the directionality of the microphone unit can easily be switched by selectively switching the output of the front and rear capacitor elements 51 and 71 or mixing the outputs therefrom. Moreover, as described above, the directionality of the output from the rear capacitor element 51 is closer to bidirectional compared with that of the output from that of the front capacitor element 71. Therefore, the directionality can be switched between wide cardioid and cardioid, between cardioid and hypercardioid, or the like by adjusting the resistance of the acoustic resistance member 55.

Figure 5:
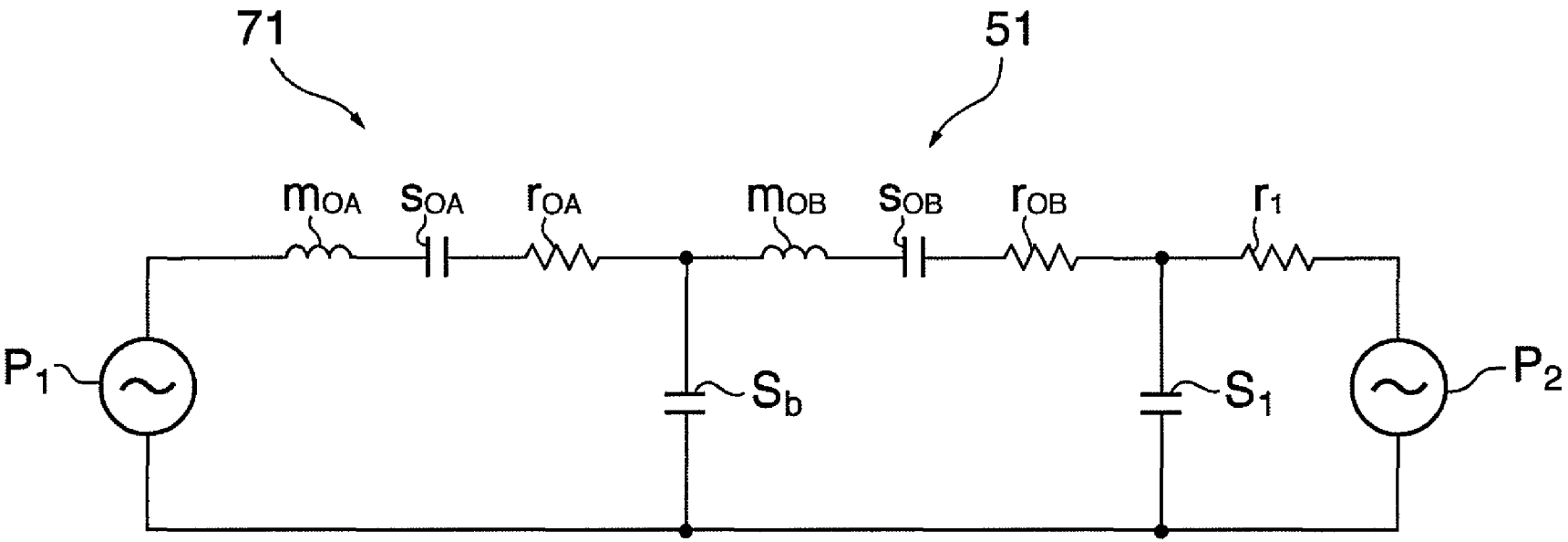
FIG. 5 is a diagram of a circuit acoustically equivalent to the variable directional microphone unit.

FIG. 5 is an equivalent circuit of the above described embodiment. In the figure, the two microphone elements 51 and 71 and the acoustic resistance $r_1$ of the acoustic resisting member 55 are acoustically connected in series. In the figure, the microphone element 71 includes: sound pressure $P_1$; mass $m_{OA}$, stiffness $s_{OA}$, and acoustic resistance $r_{OA}$ of a front air chamber; and stiffness $S_b$ of the hole formed in the fixed electrode and a rear air chamber in communication therewith. Similarly, the microphone element 51 includes: sound pressure $P_2$; mass $M_{OB}$, stiffness $s_{OB}$, and acoustic resistance $r_{OB}$ of a front air chamber; and stiffness $S_1$ of the hole formed in the fixed electrode and a rear air chamber in communication therewith.

Figure 6:
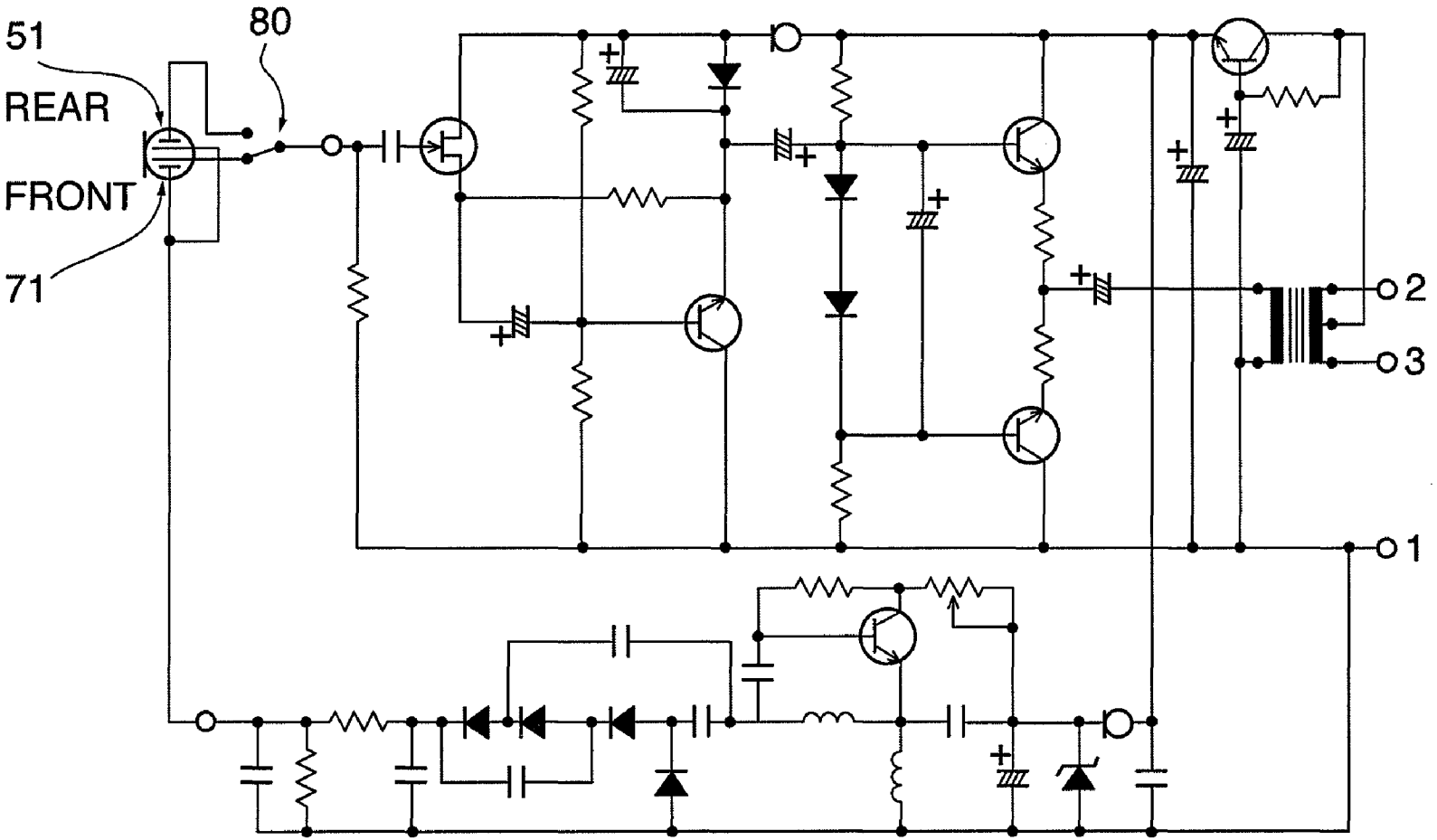
FIG. 6 is a circuit diagram of a variable directional microphone to which the variable directional microphone unit can be applied.
Figure 16:
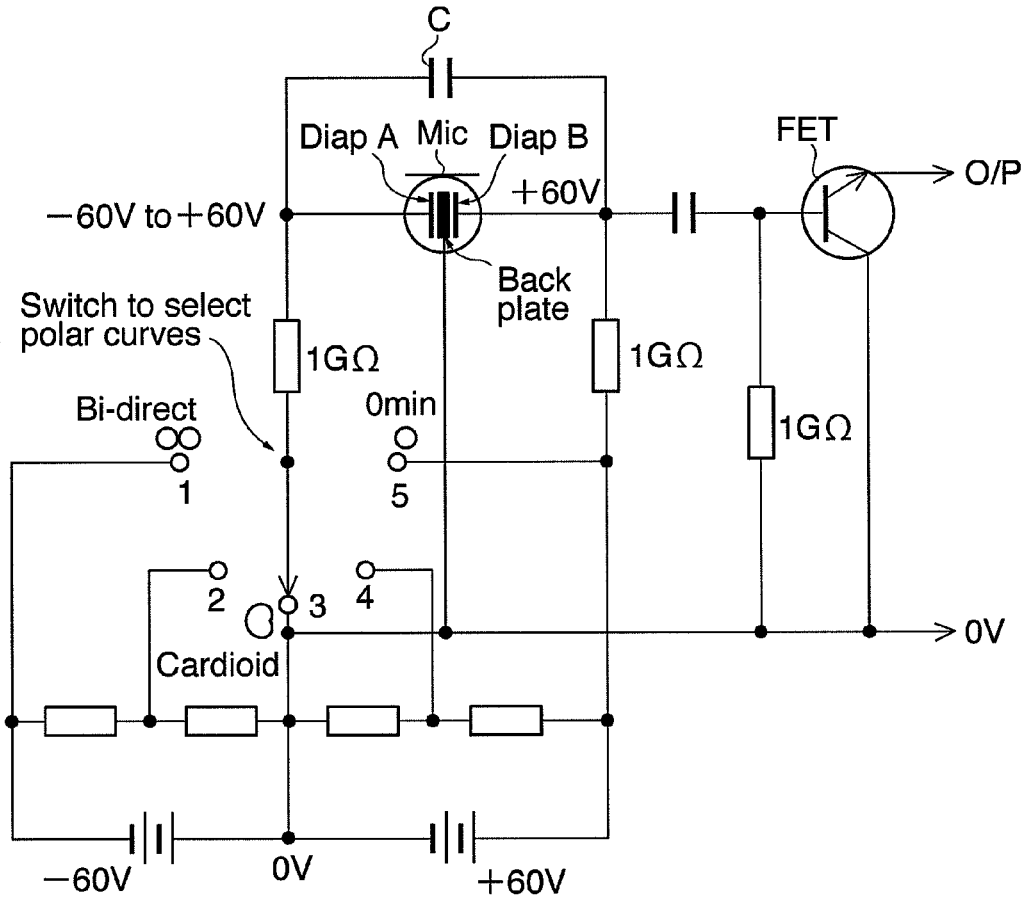
FIG. 16 RELATED ART
FIG. 16 is a circuit diagram of a variable directional microphone to which the conventional variable directional microphone unit can be applied.
Figure 17:
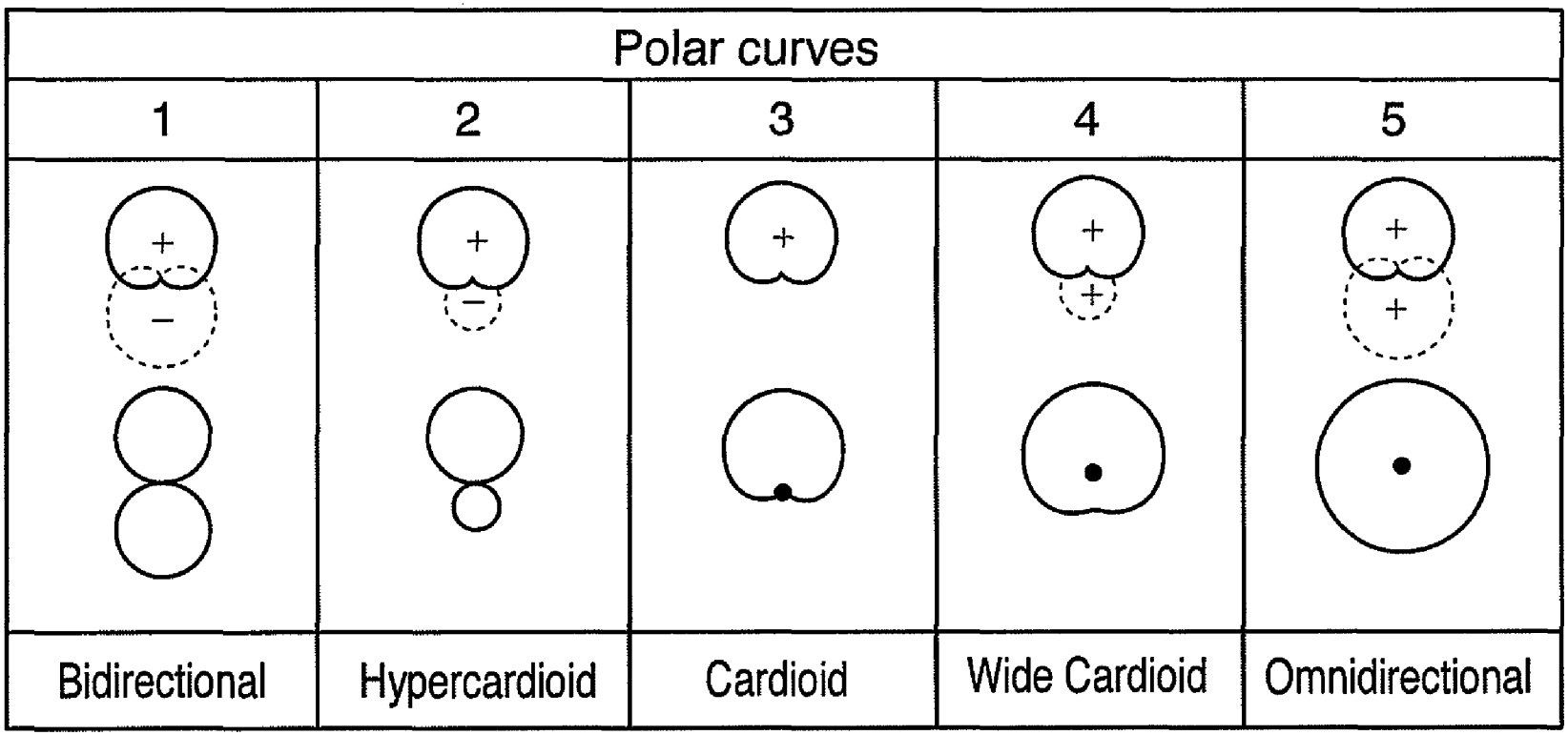
FIG. 17 is a graph depicting examples of directionalities of the microphone unit obtained through switching between polarization voltages.

FIG. 6 depicts an example of a circuit of a capacitor microphone with which the directionality is switchable that can be applied to the embodiment described above. The directionality of the output from the microphone unit can be switched by selecting between the front microphone element 71 and the rear microphone element 51 by means of a switch 80. The circuit is advantageous compared with the circuit applied in the conventional variable directional microphone unit shown in FIG. 16 in that the structure thereof can be made simple as no power sources capable of providing different levels of voltages are required. Portions other than the directionality switching circuit are not directly related to the present invention and thus, the description thereof is omitted.

Figure 7:
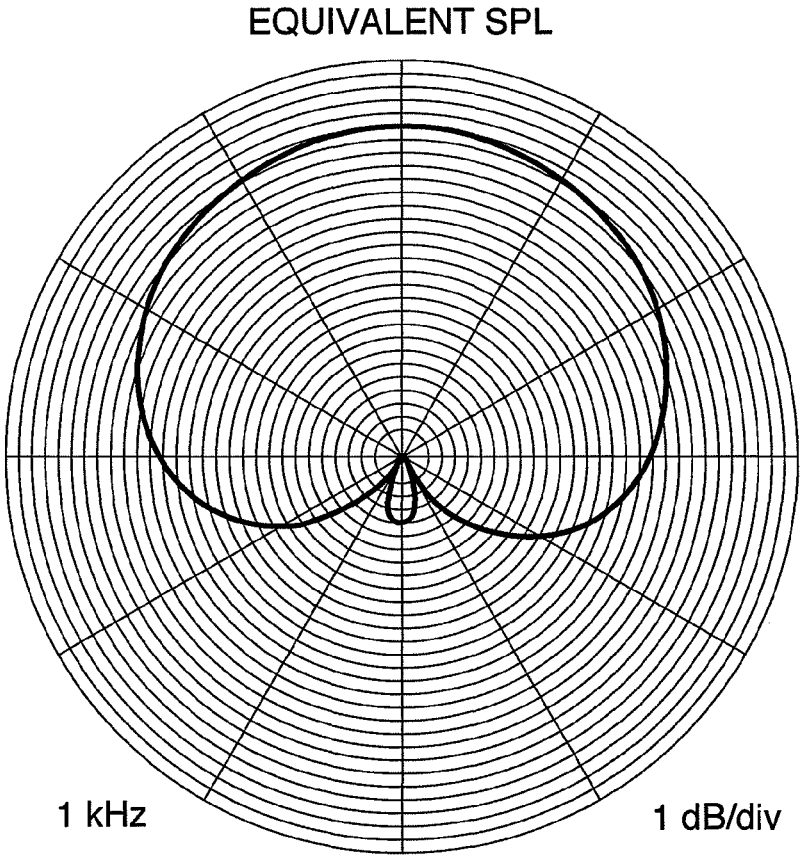
FIG. 7 is a diagram depicting a directionality of a front capacitor element of the variable directional microphone unit.
Figure 8:
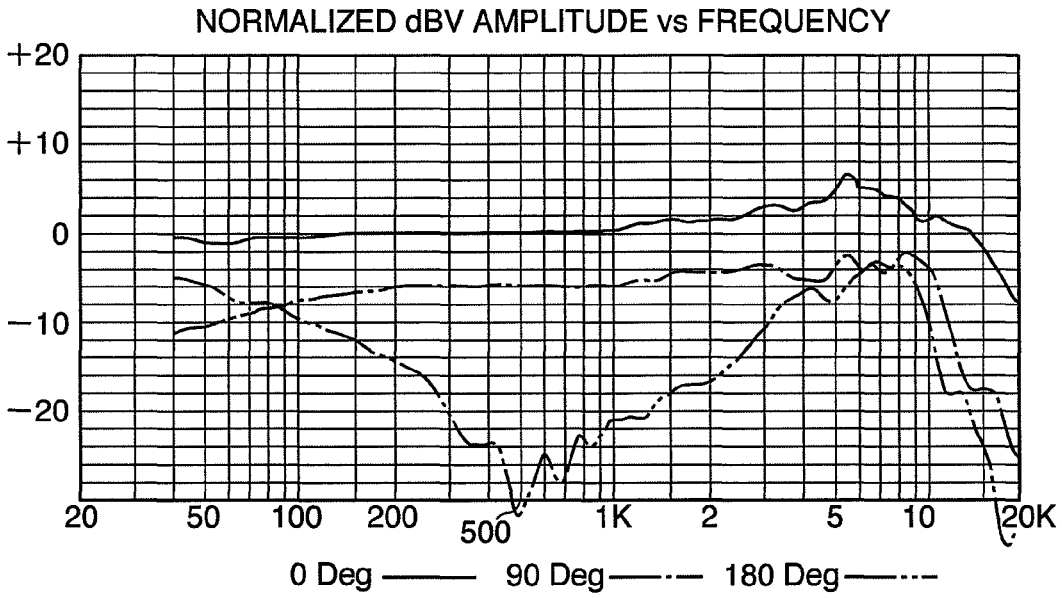
FIG. 8 is a graph depicting frequency responses of the front capacitor element.

FIGS. 7 to 10 depict directionalities and frequency responses that can be obtained with the embodiment. FIGS. 7 and 8 respectively depict directionality and frequency responses of the front capacitor element 71. Here, the directionality is cardioid. The frequency responses shown in FIG. 8 are measured at 0°, 90°, and 180° with respect to the direction into which the sound waves enter.

Figure 9:
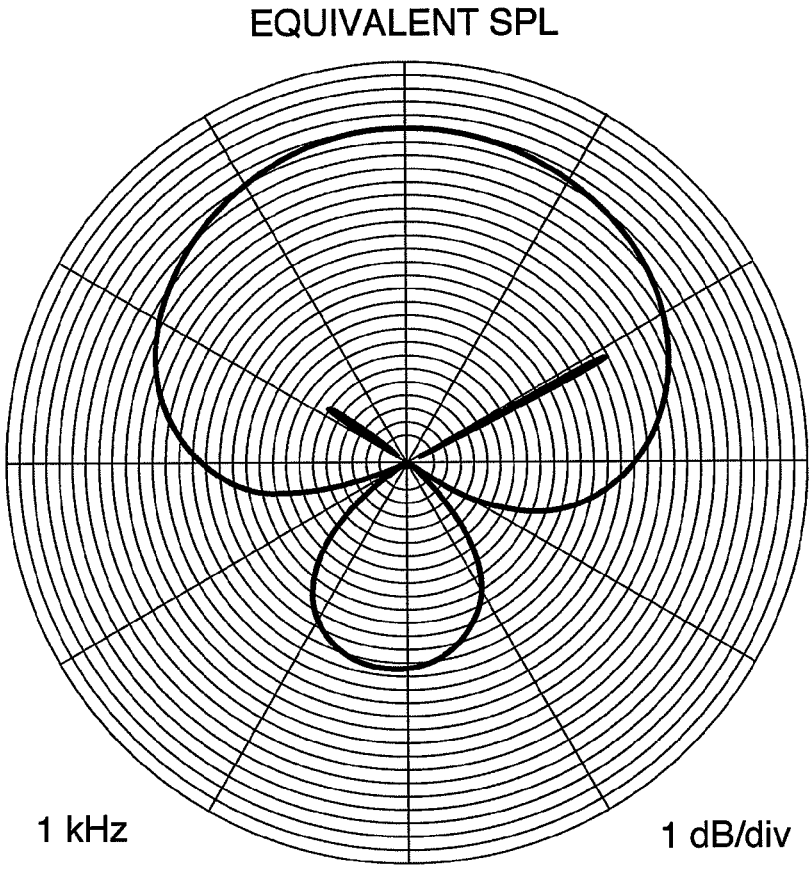
FIG. 9 is a diagram depicting a directionality of a rear capacitor element of the variable directional microphone unit.
Figure 10:
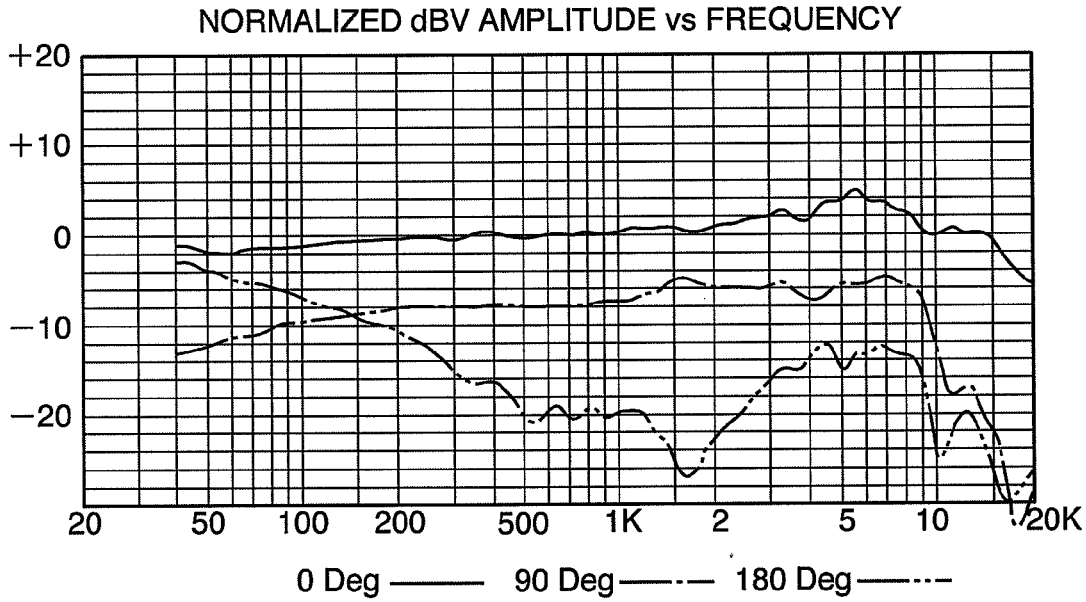
FIG. 10 is a graph depicting frequency responses of the rear variable directional microphone unit.
Figure 11:
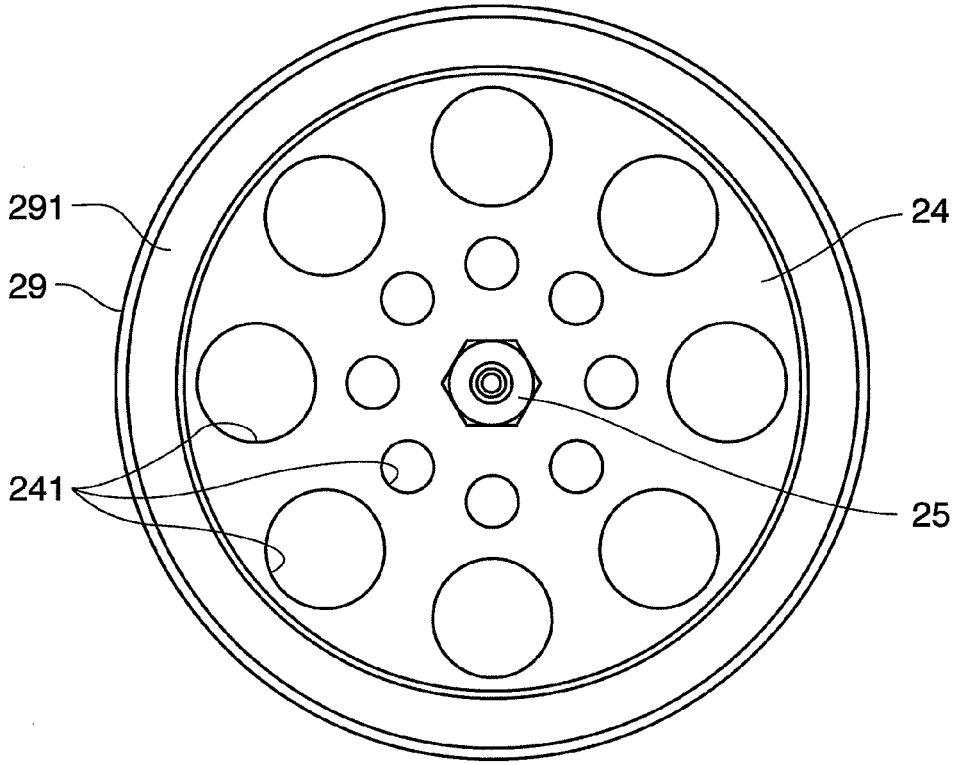
FIG. 11 RELATED ART
FIG. 11 is a rear view of an example of a conventional variable directional microphone unit.
Figure 12:
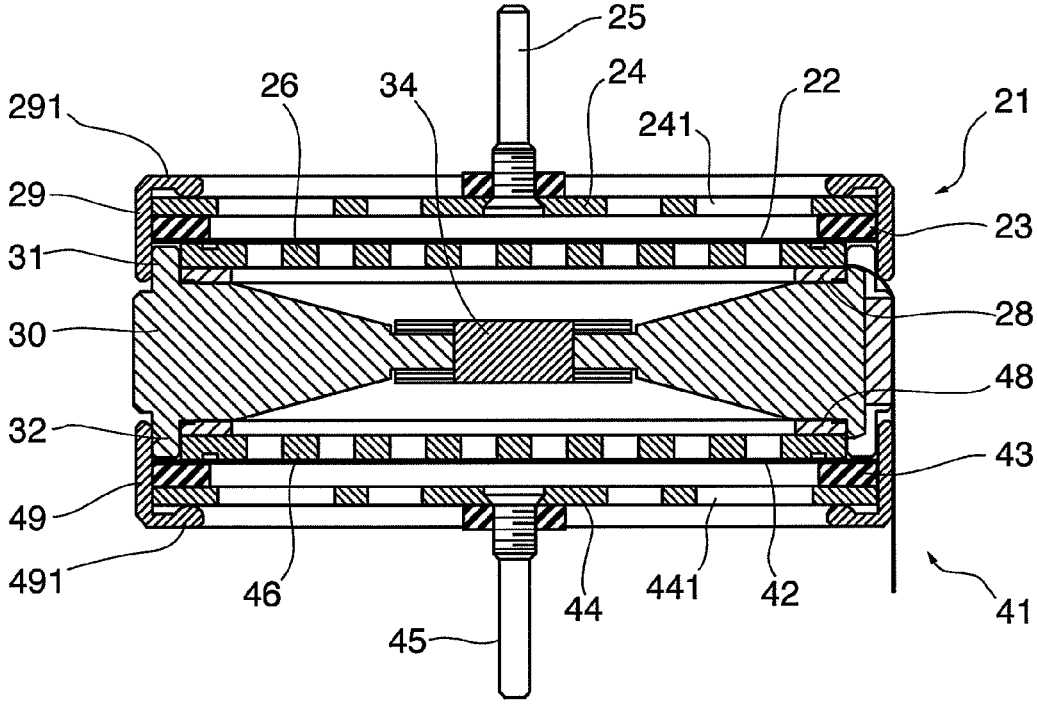
FIG. 12 RELATED ART
FIG. 12 is a vertical cross sectional view of the conventional variable directional microphone unit.
Figure 13:
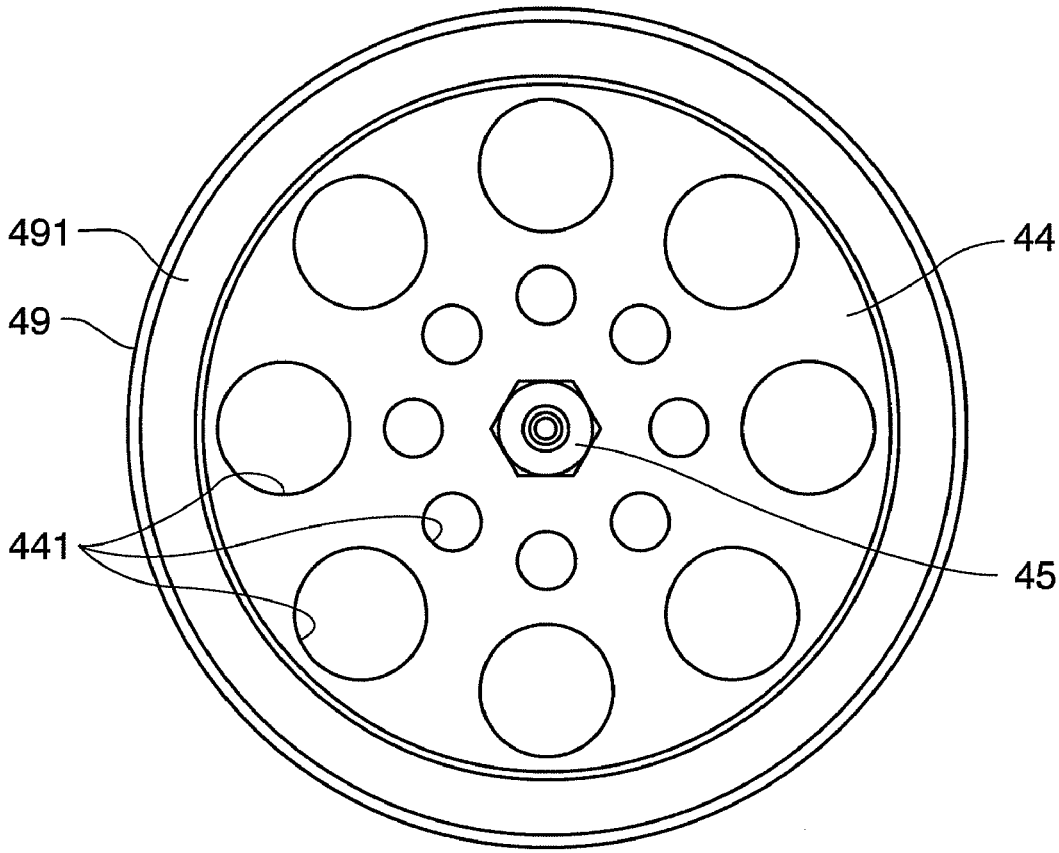
FIG. 13 RELATED ART
FIG. 13 is a front view of the conventional variable directional microphone unit.
Figure 14:
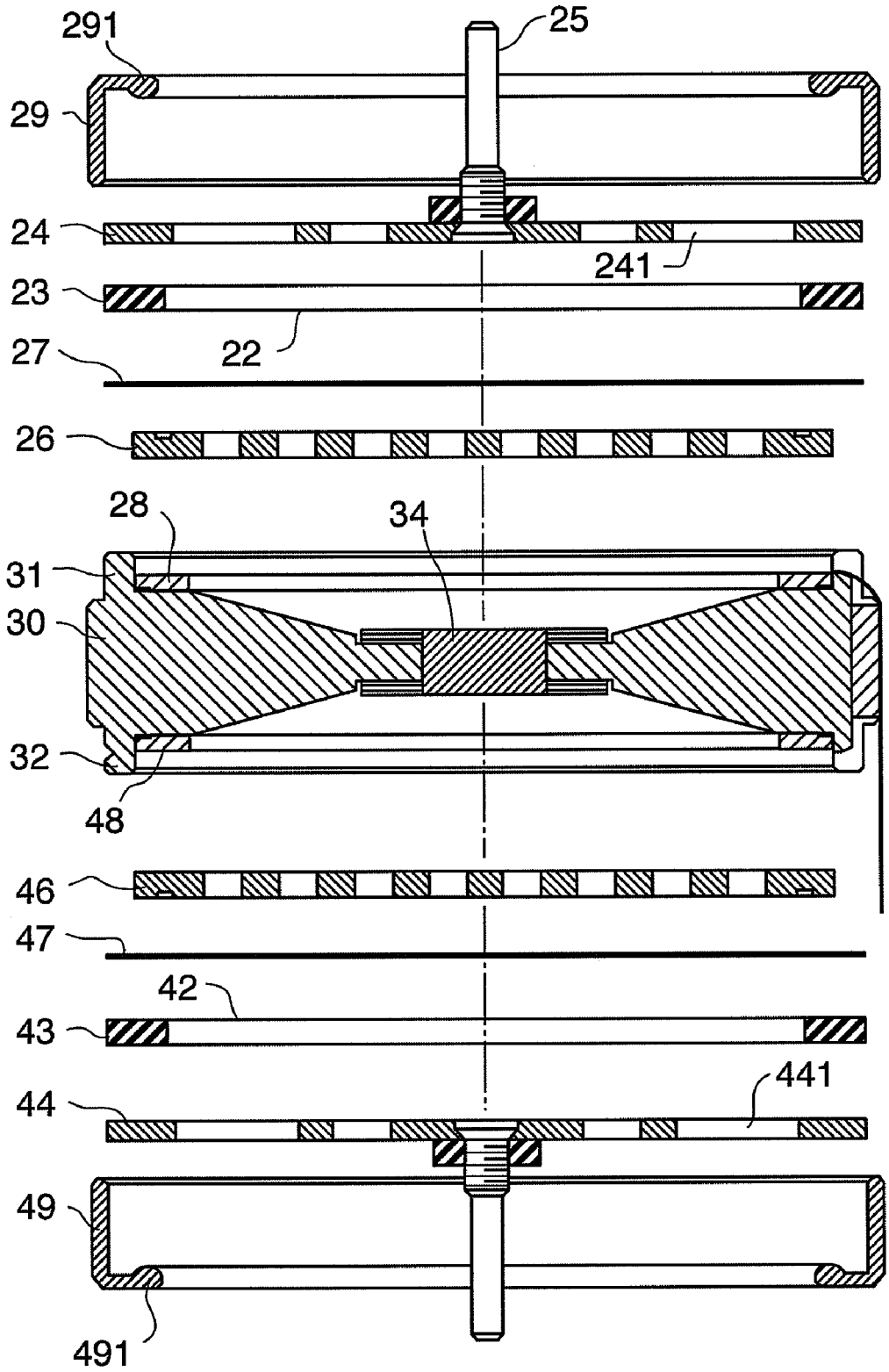
FIG. 14 RELATED ART
FIG. 14 is an exploded vertical cross sectional view of the conventional variable directional microphone unit.
Figure 15:
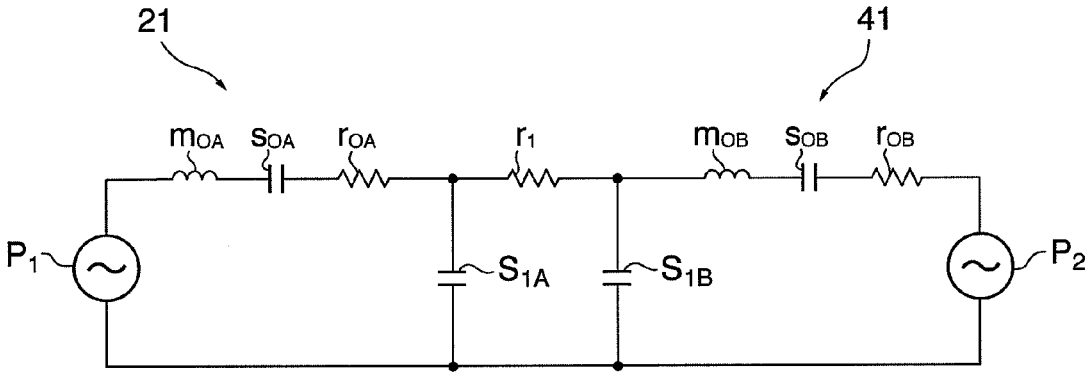
FIG. 15 RELATED ART
FIG. 15 is a diagram of a, acoustical equivalent circuit of the conventional variable directional microphone unit.

FIGS. 9 and 10 respectively depict directionality and frequency responses of the rear capacitor element 51. The directionality of the rear capacitor element 51 is closer to bidirectional compared to that of the front capacitor element 71 because the acoustic resistance $r_{OA}$ of the front capacitor element 71 serves as the front acoustic resistance of the rear capacitor element 51. Therefore, as shown in FIG. 9, the directionality is hypercardioid. The frequency responses shown in FIG. 10 are measured at 0°, 90°, and 135° with respect to the direction into which the sound waves enter.

A variable directional microphone can be formed by incorporating the above described microphone unit as well as the circuit as shown in FIG. 6 in a microphone casing. The circuit includes the switch with which the outputs from the two capacitor elements composing the variable directional microphone unit can be mixed or either one of the outputs can be selected. With the microphone casing having the switch, the user can arbitrarily select the preferable directionality.

INDUSTRIAL APPLICABILITY

With the variable directional microphone unit and the variable directional microphone according to the present invention, the directionality can be switched according to the use. Upon use, the directional characteristics are switched according to the sound the user prefers, in terms of preventing acoustic feedback, or the like.

What is claimed is:

1. A variable directional microphone unit including two capacitor elements, each of the two capacitor elements having:

a back plate formed on one side of an insulating plate to be insulated from a back plate of the other capacitor element; and a vibrating plate disposed to face the back plate with a certain amount of space therebetween, wherein a polarization voltage is applied between each of the back plates and the vibrating plates so that an electroacoustically transduced signal is obtainable from each of the back plates, the variable directional microphone unit characterized in that the capacitor elements are electrically dependently formed on both sides of the insulating plate, and the two vibrating plates of the two capacitor elements are acoustically connected in series as a plurality of holes are formed on both of the back plates.

2. The variable directional microphone unit according to claim 1, wherein the two back plates are formed on both sides of the single insulating plate.

3. The variable directional microphone unit according to claim 1, wherein the two back plates are each formed on one of the sides of the two different insulating plates and sides of the insulating plates at which the back plates are not formed are connected to each other.

4. The variable directional microphone unit according to claim 1, wherein an acoustic resisting member is provided behind the vibrating plate of one of the capacitor elements.

5. The variable directional microphone unit according to claim 4, wherein acoustic resistance of the acoustic resisting member is adjusted to make a directionality of output from the capacitor element at a front side is cardioid, where a side at which the acoustic resisting member is disposed is a rear side while a side at which the acoustic resisting member is not disposed is the front side.

6. A variable directional microphone comprising the variable directional microphone unit according to claim 1 incorporated in a microphone casing.

7. A variable directional microphone comprising:

the variable directional microphone unit according to claim 1 incorporated in a microphone casing; and a switching circuit with which directionality can be changed through selecting either one of outputs from the two capacitor elements composing the variable directional microphone unit or mixing the outputs.

* * * * *